US005421636A

United States Patent [19]

Gamble

[11] Patent Number: 5,421,636

[45] Date of Patent: Jun. 6, 1995

[54] CHILD STOOL AND HIGH CHAIR

[76] Inventor: Carol D. Gamble, 3100 Fairfield, Unit 9C, Shreveport, La. 71107

[21] Appl. No.: 45,691

[22] Filed: Apr. 14, 1993

[51] Int. Cl.[6] ..... A47C 13/00

[52] U.S. Cl. ..... 297/130; 297/134; 297/151; 182/33

[58] Field of Search ..... 297/130, 151, 134; 182/33, 33.3, 33.4

[56] References Cited

U.S. PATENT DOCUMENTS

| | | | |
|---|---|---|---|
| 190,800 | 5/1877 | Wheeler | 297/130 X |
| 198,491 | 12/1877 | Freohman | 297/134 |
| D. 224,029 | 6/1972 | Gale . | |
| 1,759,424 | 5/1930 | Strauss . | |
| 2,529,687 | 11/1950 | Greenbaum | 297/134 |
| 2,560,708 | 7/1951 | Titus | 297/134 X |
| 2,613,389 | 10/1952 | Cramer . | |
| 2,619,152 | 11/1952 | Lane | 182/33 |
| 2,658,640 | 11/1953 | Bayles . | |
| 2,955,564 | 10/1960 | Cramer . | |
| 3,557,906 | 1/1971 | Gutner . | |
| 4,199,041 | 4/1980 | Gutner . | |
| 4,765,439 | 8/1988 | Kresmery . | |

FOREIGN PATENT DOCUMENTS

| | | | |
|---|---|---|---|
| 43897 | 9/1934 | France | 297/130 |
| 842163 | 6/1939 | France | 297/130 |
| 1052275 | 1/1954 | France | 297/130 |
| 264250 | 10/1949 | Switzerland | 297/130 |

*Primary Examiner*—Laurie K. Cranmer
*Attorney, Agent, or Firm*—Brady, O'Boyle & Gates

[57] ABSTRACT

A child's stool and high chair configured as a pyramidal frustum from a box-like frame upon which a chair and table portion are detachably mounted to provide a high chair. When the chair and table portion are removed from the box-like frame, a stool is formed for a child to climb. A hook member is detachably connected to the stool and extendable over the front edge of a sink, to thereby stabilize the frame against the sink, and spring-biased caster wheels support the box-like frame above the ground to facilitate moving the box-like frame from one location to another, the weight of a child on the box-like frame causing the bottom edge portion of the box-like frame to engage the ground to thereby stabilize the frame.

9 Claims, 5 Drawing Sheets

CHILD STOOL AND HIGH CHAIR

BACKGROUND OF THE INVENTION

Various high chairs have been proposed for accommodating a child to be fed and various children's stools have been proposed to help children extend their reach to elevated areas such as sinks for washing their hands. While these various high chairs and stools have been satisfactory for their intended purposes, their function has been unilateral; that is, a high chair is employed for one purpose, viz., a seat to accommodate a child while being fed; and a stool for helping a child to out-of-reach areas.

SUMMARY OF THE INVENTION

In order to provide multi-purpose child's furniture, the child's stool and high chair of the present invention has been devised which comprises, essentially, a box-like frame upon which a chair and table portion are detachably mounted to provide a high chair. When the chair and table portion are removed from the box-like frame, the frame provides a stool for a child to climb for reaching elevated areas. The box-like frame is supported above the ground by spring-biased caster wheels to facilitate moving the box-like frame from one location to another, the weight of a child on the box-like frame causing the bottom edge portion of the box-like frame to engage the ground to thereby stabilize the frame. A hook member is detachably connected to the upper edge portion of one side of the box-like portion and extendable over the front edge of a sink, to thereby stabilize the frame against the sink.

By the construction and arrangement of the child's furniture of the present invention, a multi-purpose piece of furniture is provided which heretofore required separate pieces of furniture for each purpose.

DESCRIPTION OF THE PREFERRED EMBODIMENT

Figure 1:
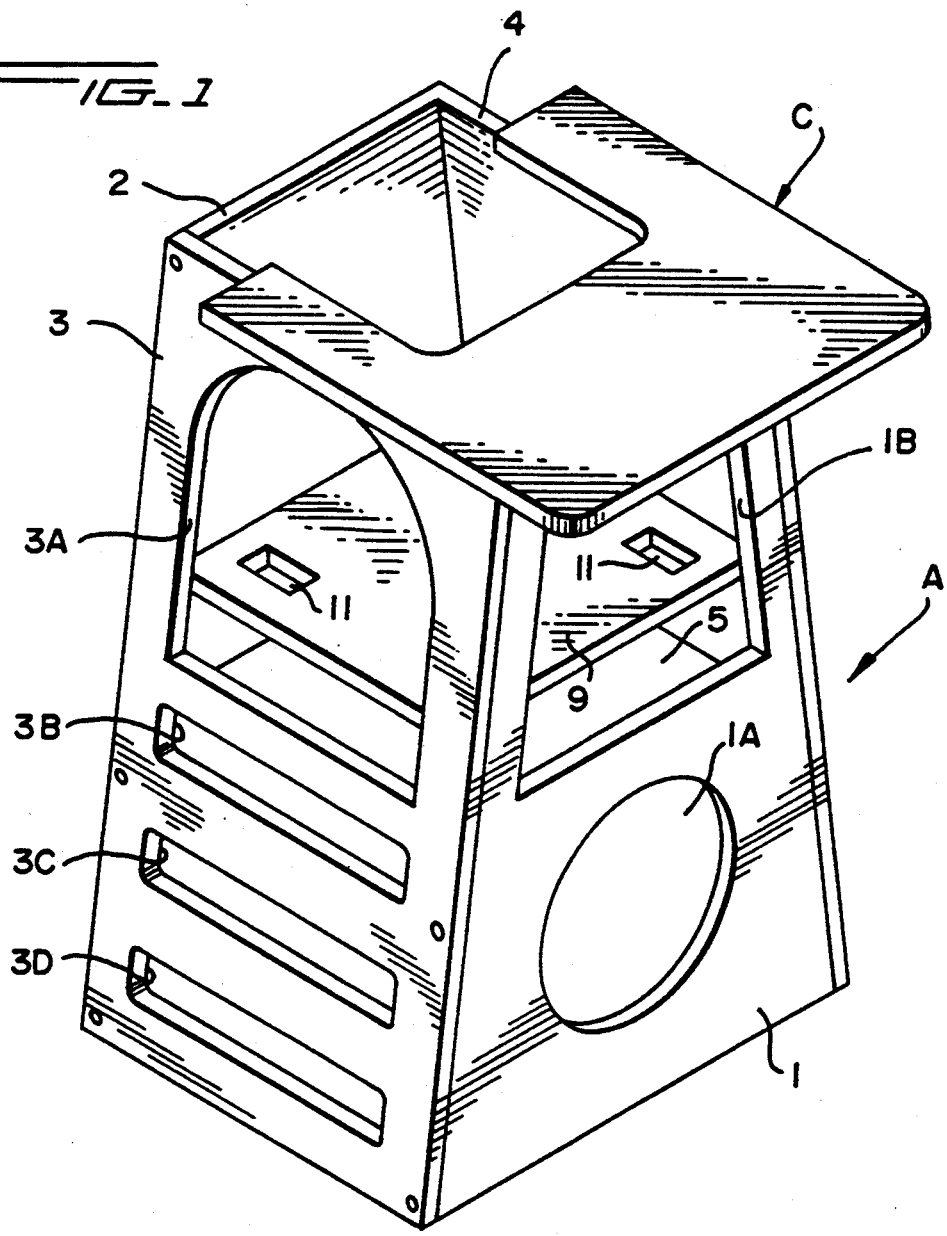
FIG. 1 is a perspective view of the child's stool of the present invention having a tray mounted thereon.
Figure 3:
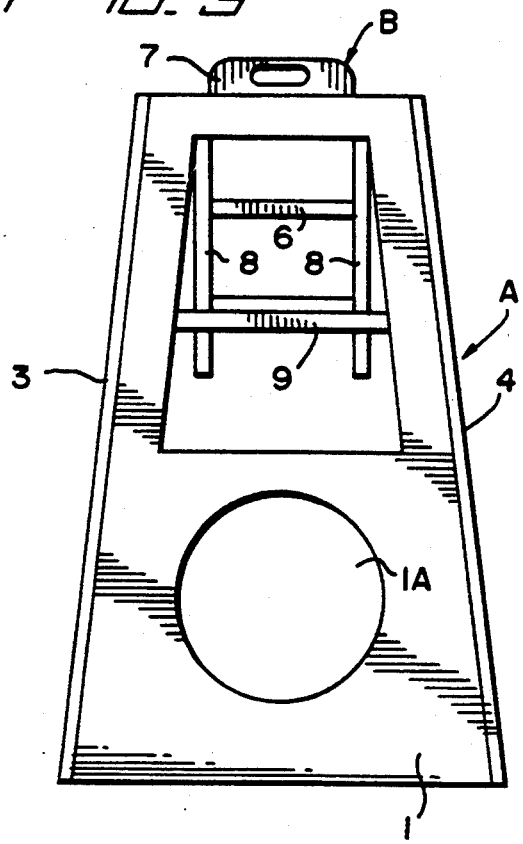
FIG. 3 is a front elevational view of the stool and high chair.
Figure 4:
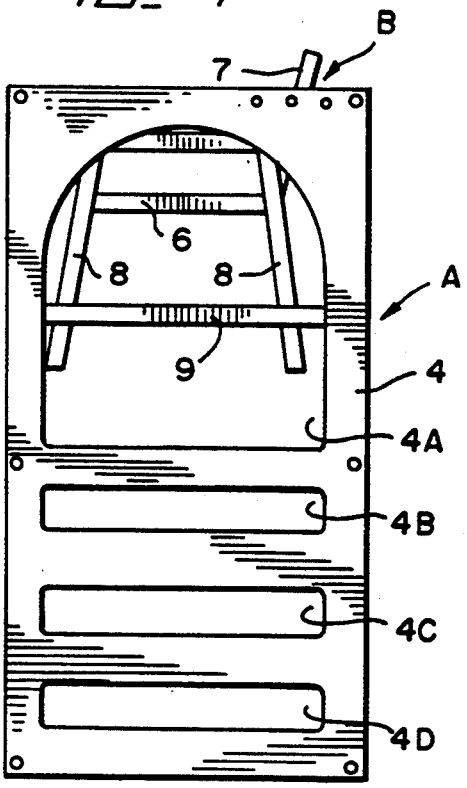
FIG. 4 is a side elevational view of the stool and associated high chair.

Referring to the drawings and more particularly to FIGS. 1, 3 and 4, the child's stool and high chair of the present invention comprises, a stool portion A, a high chair portion B and a table portion C. The stool portion includes a box-like frame in the configuration of a pyramidal frustum having a front wall 1, a rear wall 2, and side walls 3 and 4, and a floor 5. As will be seen in FIGS. 1, 3 and 10, the front wall 1 is provided with openings 1A and 1B; the rear wall is provided with openings 2A, 2B, 2C, 2D and 2E; the side wall 3 is provided with openings 3A, 3B, 3C and 3D; and the side wall 4 is provided with similar openings 4A, 4B, 4C and 4D. The openings provide ladders or foot holes so that a child can climb on the box-like frame similar to a juvenile playground structure.

As will be seen in FIGS. 1, 3, 4 and 10, the high chair portion B comprises a seat portion 6 having an integral back rest 7 and four depending legs 8.

Figure 2:
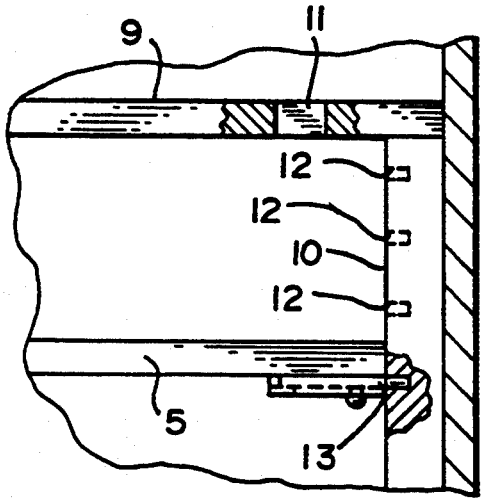
FIG. 2 is a fragmentary sectional view of one corner of the stool shown in FIG. 1.
Figure 5:
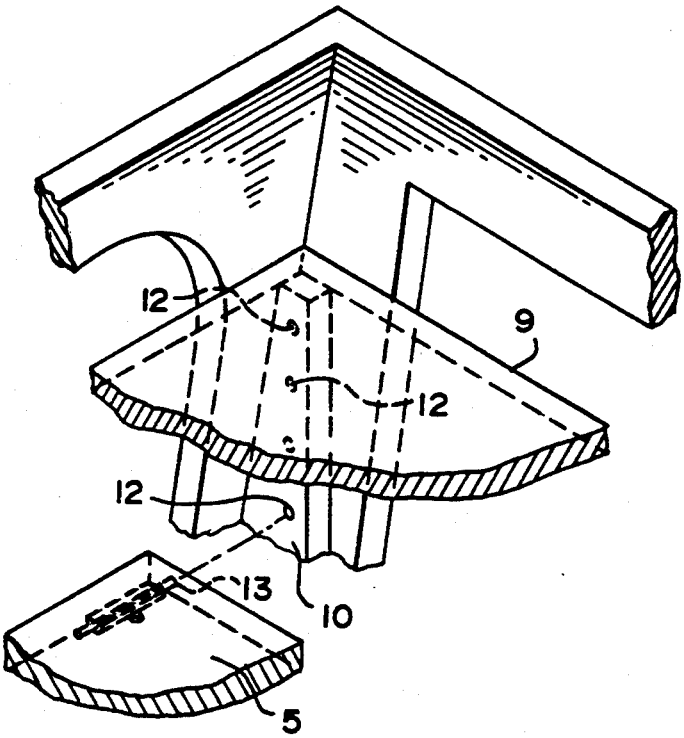
FIG. 5 is a fragmentary, perspective view showing the corner construction shown in FIG. 2.
Figure 6:
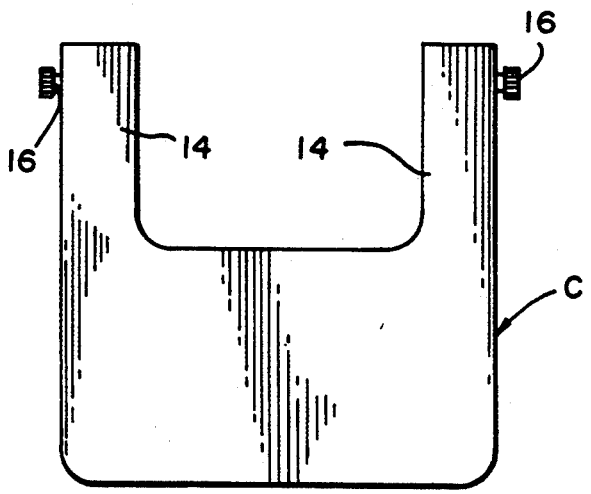
FIG. 6 is a top plan view of the tray used with the stool.
Figure 7:
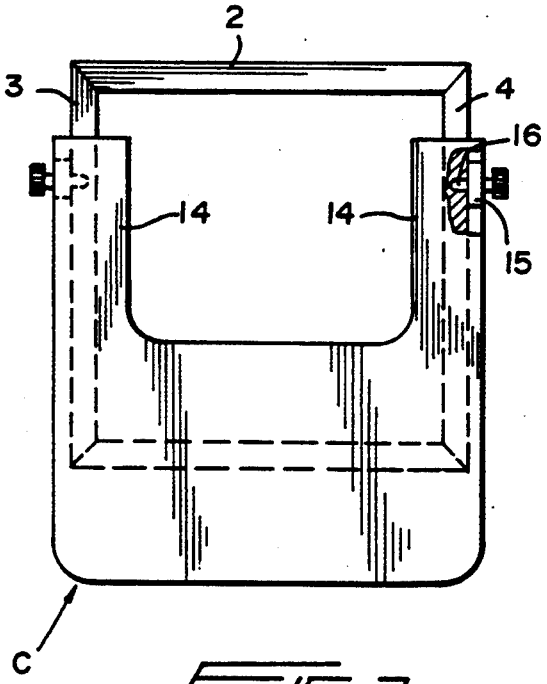
FIG. 7 is a top plan view of the tray mounted on the stool.

The chair B is removably mounted in the stool portion A by a platform 9 positioned above the floor 5 and supported within the stool portion by pedestals 10, FIGS. 2 and 5, secured to the four interior corners of the stool portion A. The platform 9 is provided with openings 11 for receiving the chair legs 8, whereby the chair B is constrained from moving while positioned in the stool portion A. While the platform rests on the top of the four pedestals 10 and is stationary thereon, each pedestal 10 is provided with a plurality of vertically spaced apertures 12 for selectively receiving a bolt 13 slidably mounted on the stool floor 5, whereby the position of the floor 5 relative to the platform 9 can be adjusted.

Figure 8:
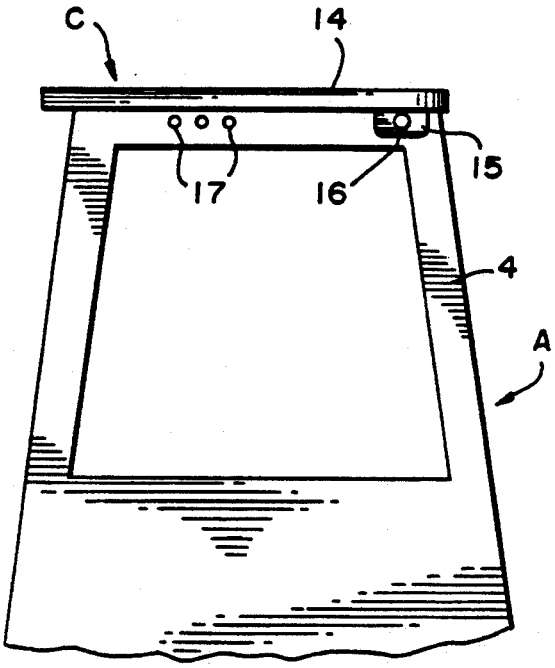
FIG. 8 is a side elevational view of the tray mounted on the stool.
Figure 9:
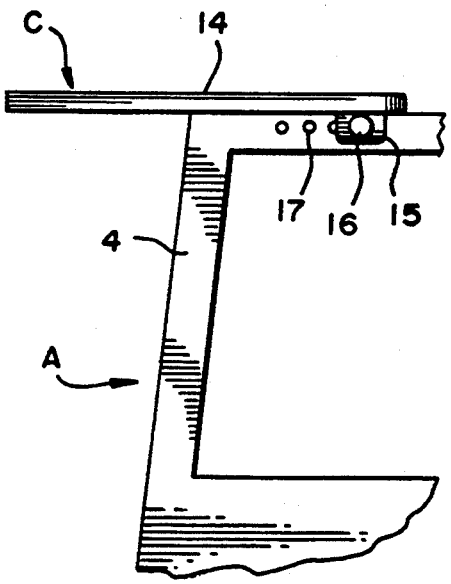
FIG. 9 is a fragmentary, side elevational view of the tray mounted on the stool and moved to an extended position.

Referring to FIGS. 6 to 9, the table portion C includes a pair of arms 14 slidably mounted on the top edges of side walls 3 and 4 of the stool portion A. A depending bracket 15 is secured to the lower surface of each arm 14 and carries a spring-biased pin 16 adapted to be selectively received in a plurality of holes 17 provided in the upper portions of the side walls 3 and 4, whereby a detent is provided for adjustably positioning the table portion C from a retracted position, as shown in FIG. 8, to an extended position, as shown in FIG. 9.

Figure 10:
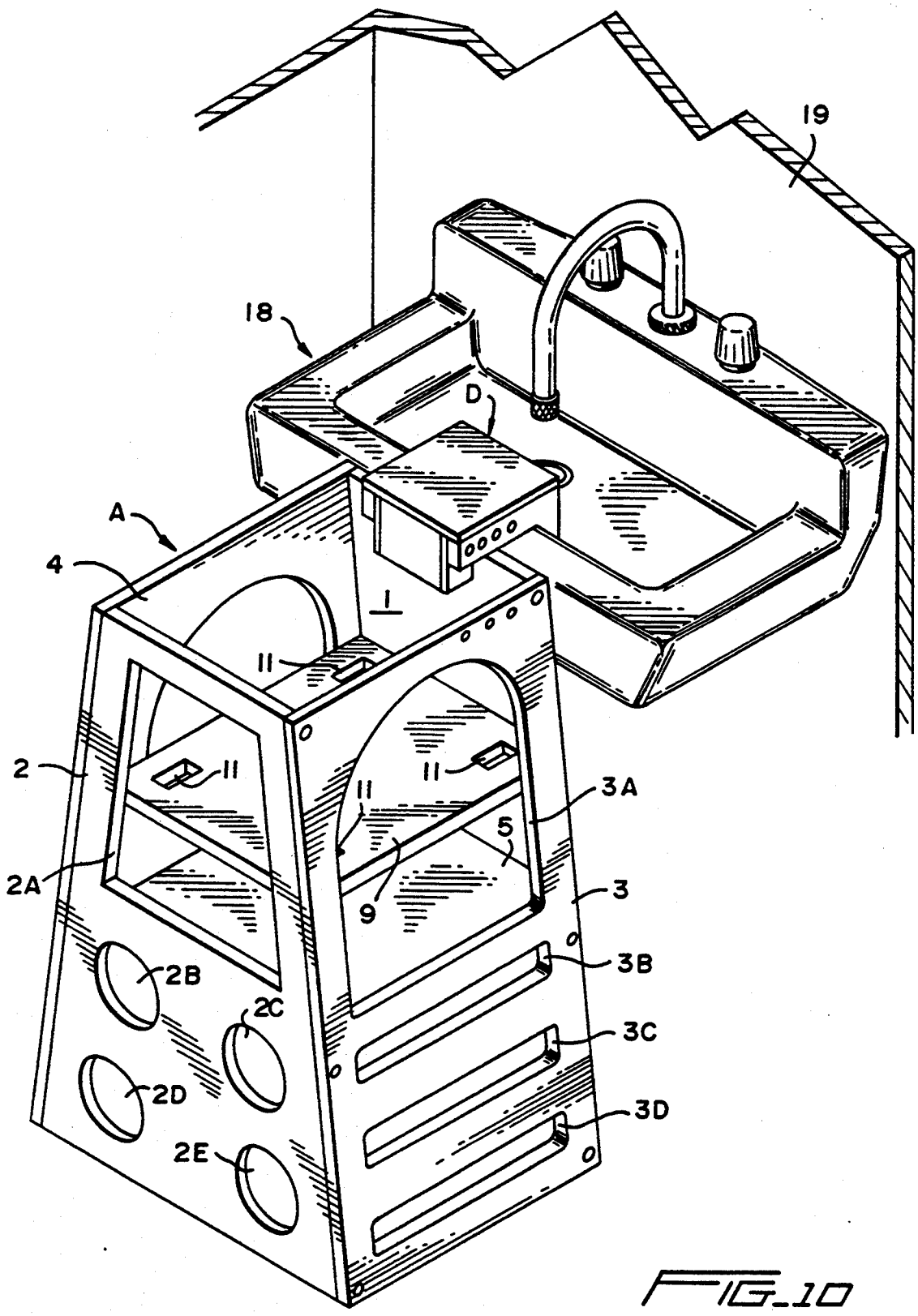
FIG. 10 is a perspective view of the stool hooked to the side of a sink.
Figure 11:
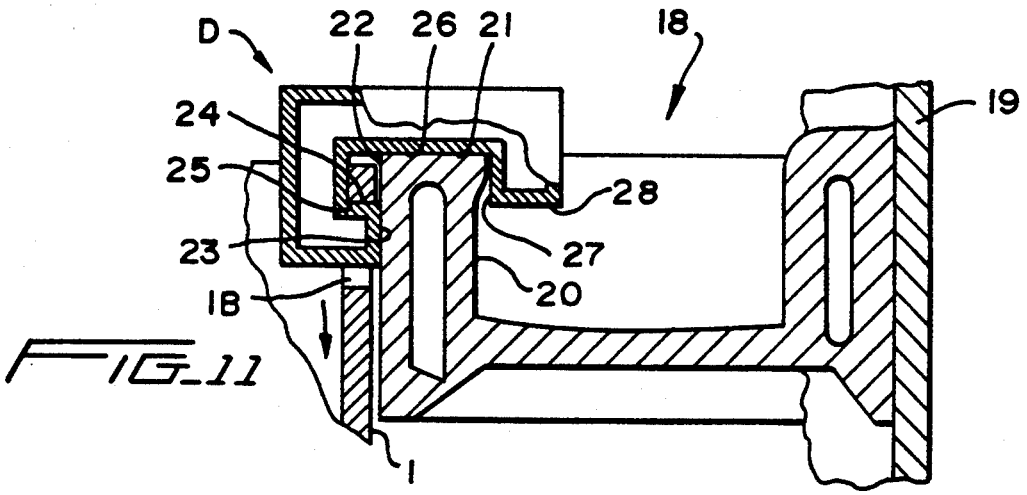
FIG. 11 is a fragmentary, sectional, side elevational view showing the hook member being moved to the operative position between the stool and the sink.

As will be seen in FIG. 10, when the chair B and table portion C are removed, the box-like frame portion forms a stool A to provide a child a ladder to reach a sink 18 extending outwardly from a wall 19. To stabilize and hold the stool A against the sink, a hook member D is provided, and as will be seen in FIGS. 11 and 12 sink 18 includes a front wall 20 having a top edge portion 21 and an outer wall surface 22. The hook portion includes a vertical wall portion 23 engageable with the outer wall surface 22 of the sink, a horizontal surface portion 24 extending through the opening 1B in the stool front wall 1 and engageable with a horizontal portion 25 provided in the portion of the side wall 1 adjacent the opening 1B, another horizontal portion 26 engageable with the sink top edge portion 21, and vertical and horizontal wall portions 27 and 28, respectively, extending beyond the sink edge portion 21 and downwardly in proximity to the sink front wall 20. The dimensions of the hook member D and opening 1B are such that there is a clearance between the cooperating portions of the hook D so that when the stool A is moved downwardly as indicated by the arrow in FIG. 11, the horizontal surface 25 on the side wall 1B will engage the horizontal surface portion 24 on the hook causing the hook to move downwardly into engagement with the edge of the sink 18.

Figure 12:
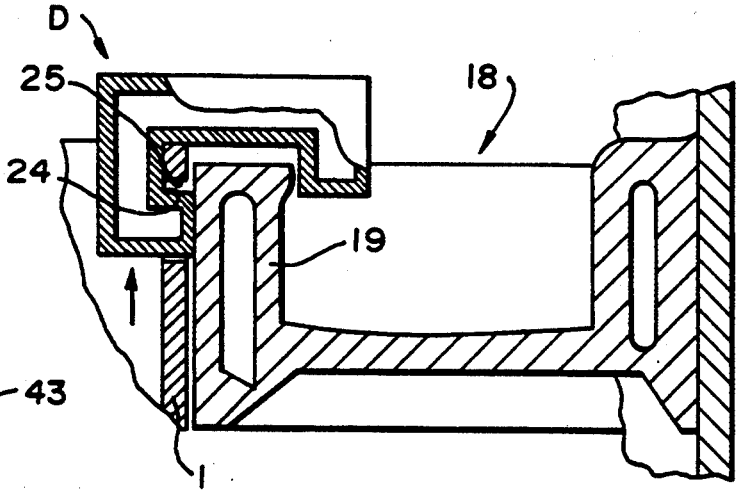
FIG. 12 is a fragmentary, sectional, side elevational view similar to FIG. 11 but showing the hook member being detached from the stool and the sink.

When the stool is lifted upwardly in the direction indicated by the arrow in FIG. 12, the horizontal surface 25 moves upwardly away from the horizontal surface portion 24 of the hook, to thereby allow the hook member D to be manually removed from the stool A and the sink 18.

While FIG. 10 shows the platform 9 positioned in the stool portion A, it can be removed therefrom so that a child can stand on the floor 5 while using the sink 18.

Figure 13:
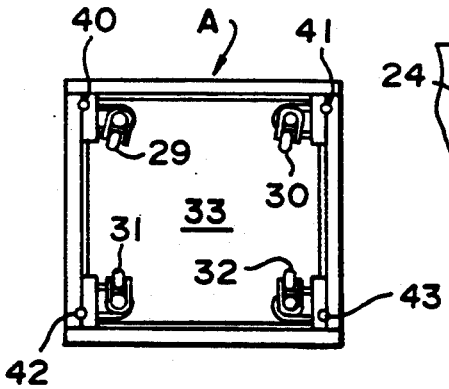
FIG. 13 is a bottom plan view of the stool showing the spring-biased caster wheels.
Figure 14:
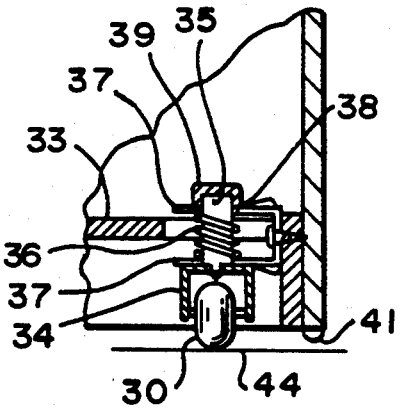
FIG. 14 is a fragmentary, sectional, side elevational view showing the bottom edge of the stool being supported above the ground by a spring-biased caster wheel.
Figure 15:
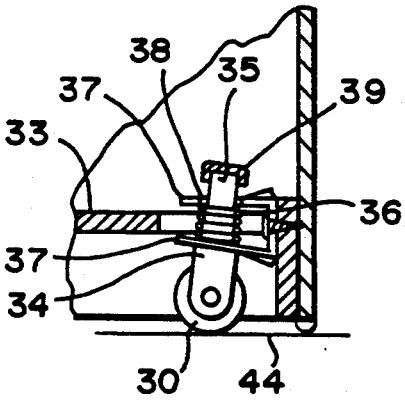
FIG. 15 is a fragmentary, sectional, side elevational view of a spring-biased caster wheel moved to the non-supporting position wherein the lower edge portion of the stool engages the ground.

In order to facilitate moving the child stool and high chair from one place to another, as will be seen in FIGS. 13 to 15, spring-biased caster wheels 29, 30, 31 and 32 are mounted underneath a bottom wall 33 of the stool portion A and positioned at the four corners of the box-like frame. Each wheel is carried by a fork member 34 having a stem 35 extending upwardly therefrom and biased in the vertical position by a light spring 36 biased between the arms 37 of a bracket having an opening as at 38 through which the end portion of the stem 35 extends and upon which a cap 39 is mounted. Each bracket is positioned within an aperture 33A provided in the bottom wall 33 of the box-like frame. Each corner of the box-like frame is provided with a rubber button or foot 40, 41, 42, 43 which are in an elevated position above the ground 44 as shown in FIG. 14 when the child stool and high chair are wheeled from one location to another but engage the ground, as shown in FIG. 15, when a child is placed on the stool-high chair, the weight of the child compressing the spring 36 and tilting the stem 35 and associated wheel.

From the above description, it will be apparent to those skilled in the art that the child's stool and high chair of the present invention provides a multi-purpose piece of furniture readily functional from infancy to young childhood. During infancy, the high chair portion B and table portion C remain mounted on the stool portion A to facilitate feeding a baby in the high chair B. As the child grows older and the high chair is no longer needed, the chair and associated platform 9 can be removed from the stool portion A, and the child can climb and play on the stool portion as would be done on a juvenile playground structure. The stool portion can also be moved against and hooked to a sink, as shown in FIG. 10, to encourage the child to wash his hands.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. The combination of a child stool and high chair comprising, a box-like frame means having a front wall, a rear wall, a bottom and side walls forming the stool for a child to climb on for reaching elevated areas, a chair portion, a table portion, and a hook member, said chair and table portions and hook member being freely and selectively attachable to the box-like frame means, whereby the stool can be converted to either a high chair, a high chair having a table portion or merely a stool hooked to the side of a sink having a front wall and top edge portion, to thereby stabilize the stool against the sink while a child is on the stool.

2. A child stool and high chair according to claim 1, wherein the box-like frame means comprises a pyramidal frustum, openings formed in said front, rear and side walls to provide foot holes, whereby a child can climb on the box-like frame means similar to a juvenile playground structure.

3. A child stool and high chair according to claim 1, wherein an aperture is provided in the front wall of the stool, the hook member having one end portion insertable within said aperture, the other end portion of the hook member extending over the front wall of the sink, and a horizontal portion extending between said end portions engageable with the sink top edge portion.

4. A child stool and high chair according to claim 1, wherein a plurality of spring-biased caster wheels are mounted underneath the bottom wall of the box-like frame means to facilitate moving the child stool and high chair from one place to another, the front, rear and side walls of the box-like frame means having bottom edges normally spaced above a floor supporting the stool, the bottom edges of the front, rear and side walls of the box-like frame means engageable with the floor due to the weight of a child on the stool and high chair causing the box-like frame means to move downwardly against the upwardly biasing force of the spring-biased caster wheels.

5. The combination of a child stool and high chair comprising, box-like frame means forming a stool for a child to climb on for reaching elevated areas, said box-like frame means having a front wall, a rear wall, side walls, a bottom wall, and a floor positioned above the bottom wall, a platform mounted within said box-like frame means above said floor, a chair having depending legs positioned in said box-like frame means, openings provided in said platform, the chair legs extending through said openings, whereby the chair is constrained from moving while positioned in the box-like frame means.

6. A child stool and high chair according to claim 5, wherein a pedestal is positioned at each interior corner of the box-like frame means and extending upwardly from the bottom wall, said platform being supported by said pedestals above said floor.

7. A child stool and high chair according to claim 6, wherein a plurality of vertically spaced apertures are provided in each pedestal, a plurality of bolts slidably mounted on the floor and receivable in a selective aperture in a respective pedestal, whereby the position of the floor relative to the platform can be adjusted.

8. A child stool and high chair according to claim 5, wherein the side walls of the box-like frame means have top edges, a table portion slidably mounted on the top edges of said side walls, said table portion having a pair of arms slidably mounted on the top edges of said side walls, and detent means operatively connected between the table arms and the side walls of the box-like frame means, whereby the table portion may be adjusted in a lateral direction relative to the box-like frame means.

9. A child stool and high chair according to claim 8, wherein the detent means comprises a depending bracket secured to the bottom surface of each arm, a spring-biased pin mounted in each bracket, and a plurality of spaced holes provided in the side walls of said box-like frame means in the vicinity of the top edges thereof, whereby the spring-biased pins can be selectively received in said holes.

* * * * *